US011145164B2

(12) United States Patent
Gomez et al.

(10) Patent No.: US 11,145,164 B2
(45) Date of Patent: Oct. 12, 2021

(54) GAMING MACHINE HAVING PERIPHERAL REELS, A SELECTIVELY TRANSPARENT FRONT DISPLAY, AND MOTOR DRIVEN REELS BEHIND THE FRONT DISPLAY

(71) Applicant: Gemini Digital Development, Inc., Las Vegas, NV (US)

(72) Inventors: Ben Gomez, Chicago, IL (US); James P. Jackson, Henderson, NV (US); Alfred Thomas, Las Vegas, NV (US)

(73) Assignee: Gemini Digital Development, Las Vegas, NV (US)

( * ) Notice: Subject to any disclaimer, the term of this patent is extended or adjusted under 35 U.S.C. 154(b) by 210 days.

(21) Appl. No.: 16/659,317

(22) Filed: Oct. 21, 2019

(65) Prior Publication Data

US 2020/0051395 A1 Feb. 13, 2020

Related U.S. Application Data

(63) Continuation-in-part of application No. 16/026,756, filed on Jul. 3, 2018, now Pat. No. 10,475,294, which is a continuation-in-part of application No. 14/338,792, filed on Jul. 23, 2014, now Pat. No. 10,043,350.

(60) Provisional application No. 61/857,577, filed on Jul. 23, 2013.

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC ... G07F 17/3267; G07F 17/3213; G07F 17/34
See application file for complete search history.

(56) References Cited

U.S. PATENT DOCUMENTS 2,152,599 A * 3/1939 Mills ..... G07F 17/3213 273/143 R
3,759,525 A * 9/1973 Davis ..... G07F 17/3213 273/143 R
3,910,582 A * 10/1975 Richards ..... G07F 17/34 273/143 R
3,913,922 A * 10/1975 Richards ..... G07F 17/34 273/143 R (Continued)

*Primary Examiner* — Omkar A Deodhar
*Assistant Examiner* — Matthew D Hoel
(74) *Attorney, Agent, or Firm* — Patent Law Group; Brian D. Ogonowsky

(57) ABSTRACT

A gaming machine platform includes a front display that is controllable to be opaque and display symbols during a first mode of operation, and controllable to be transparent to reveal a set of stepper motor driven reels during a second mode of operation. The front display may be part of larger display screen that displays peripheral reels that surround the front display. In one type of game, the front display displays a randomly selected array of symbols, and the peripheral reels display scatter symbols that are combinable with the front display symbols in a primary game to generate awards and possibly trigger a bonus game. When the bonus game is triggered, the front display becomes transparent to reveal the stepper driven reels for a bonus game. The bonus game may or may not use the peripheral reels.

20 Claims, 8 Drawing Sheets

(56) References Cited

U.S. PATENT DOCUMENTS 4,095,795 A * 6/1978 Saxton ..... G07F 17/3241 463/20
4,198,052 A 4/1980 Gauselmann
4,240,635 A * 12/1980 Brown ..... G07F 17/3211 194/244
4,260,635 A * 4/1981 Fisher ..... A23K 50/42 426/3
4,448,419 A * 5/1984 Telnaes ..... G07F 17/3244 273/143 R
4,573,681 A * 3/1986 Okada ..... G07F 17/3244 463/21
4,600,197 A * 7/1986 Bean ..... G07F 17/34 273/143 R
4,711,451 A * 12/1987 Pajak ..... G07F 17/3244 273/143 R
4,732,386 A 3/1988 Rayfiel
4,838,552 A * 6/1989 Hagiwara ..... G07F 17/3211 463/20
4,838,554 A * 6/1989 Sutter ..... A45C 1/12 273/143 R
5,085,436 A * 2/1992 Bennett ..... G07F 17/3244 273/143 R
5,102,137 A * 4/1992 Ekiert ..... G07F 17/3244 273/143 R
5,152,529 A * 10/1992 Okada ..... G07F 17/3213 273/143 R
5,162,696 A * 11/1992 Goodrich ..... G09F 9/33 257/E25.02
5,169,147 A * 12/1992 Hamano ..... G07F 17/3244 273/143 R
5,205,555 A 4/1993 Hamano
RE34,244 E * 5/1993 Hagiwara ..... G07F 17/3211 273/143 R
5,209,477 A * 5/1993 Heidel ..... G07F 17/3213 248/221.12
5,209,479 A * 5/1993 Nagao ..... G07F 17/3244 273/143 R
5,219,167 A * 6/1993 Hamano ..... G07F 17/3244 273/143 R
5,395,111 A 3/1995 Inoue
5,413,342 A * 5/1995 Kaplan ..... G07F 17/3213 273/143 B
5,423,539 A * 6/1995 Nagao ..... G07F 17/3244 273/143 R
5,423,540 A * 6/1995 Taxon ..... G07F 17/3213 273/143 R
5,423,541 A * 6/1995 Nicastro ..... G07F 17/3244 463/20
5,456,465 A * 10/1995 Durham ..... G07F 17/34 463/21
5,569,084 A * 10/1996 Nicastro ..... G07F 17/3244 463/20
5,683,296 A * 11/1997 Rasmussen ..... G07F 17/34 273/143 R
5,688,172 A * 11/1997 Lorenzo Regidor ..... G07F 17/3213 273/143 R
5,697,843 A * 12/1997 Manship ..... G07F 17/3244 273/143 R
5,722,891 A 3/1998 Inoue
5,725,428 A * 3/1998 Achmuller ..... G07F 17/34 273/143 R
5,752,881 A * 5/1998 Inoue ..... G07F 17/3211 273/143 R
5,815,085 A * 9/1998 Schneider ..... B66F 9/07 340/3.31
5,848,932 A 12/1998 Adams
5,878,781 A * 3/1999 Parker ..... F16K 11/0743 137/625.43
5,882,261 A 3/1999 Adams
5,911,418 A 6/1999 Adams
5,938,196 A * 8/1999 Antoja ..... G07F 17/3244 273/143 C
5,938,529 A * 8/1999 Rodesch ..... G05B 19/40 463/20
5,984,781 A * 11/1999 Sunaga ..... G07F 17/3244 463/20
5,988,638 A * 11/1999 Rodesch ..... G07F 17/32 273/143 R
6,003,867 A * 12/1999 Rodesch ..... G07F 17/32 273/143 R
6,027,115 A * 2/2000 Griswold ..... G07F 17/3211 273/143 R
6,071,190 A * 6/2000 Weiss ..... G07F 17/32 463/16
6,086,066 A * 7/2000 Takeuchi ..... G07F 17/3211 273/138.2
6,162,121 A 12/2000 Morro et al.
6,186,894 B1 * 2/2001 Mayeroff ..... G07F 17/32 273/138.1
6,224,483 B1 5/2001 Mayeroff
6,224,484 B1 5/2001 Okuda et al.
6,227,971 B1 5/2001 Weiss
6,241,607 B1 6/2001 Payne et al.
6,270,412 B1 * 8/2001 Crawford ..... G07F 17/3265 273/143 R
6,315,663 B1 * 11/2001 Sakamoto ..... G07F 17/3265 463/20
6,375,570 B1 4/2002 Poole
6,394,900 B1 * 5/2002 McGlone ..... G07F 17/3202 273/142 R
6,413,162 B1 * 7/2002 Baerlocher ..... G07F 17/3202 273/143 R
6,419,583 B1 * 7/2002 Crumby ..... G07F 17/32 273/138.1
6,475,087 B1 * 11/2002 Cole ..... A63F 13/08 463/20
6,481,713 B2 11/2002 Perrie et al.
6,517,433 B2 * 2/2003 Loose ..... G07F 17/3202 463/20
6,517,437 B1 * 2/2003 Wells ..... G07F 17/3211 273/143 R
6,523,824 B1 * 2/2003 Colapinto ..... G07F 17/32 273/143 R
6,533,664 B1 * 3/2003 Crumby ..... G07C 15/006 463/22
6,547,242 B1 4/2003 Sugiyama et al.
6,638,165 B2 * 10/2003 Uchiyama ..... G07F 17/3211 273/292
6,644,663 B2 * 11/2003 Seelig ..... G07F 17/3213 273/143 R
6,652,378 B2 11/2003 Cannon et al.
6,656,040 B1 12/2003 Brosnan et al.
6,702,675 B2 3/2004 Poole et al.
6,817,946 B2 * 11/2004 Motegi ..... G07F 17/3211 273/138.1
6,832,957 B2 12/2004 Falconer
6,866,582 B2 * 3/2005 Watanabe ..... G07F 17/3227 463/20
6,893,345 B2 * 5/2005 Motegi ..... G07F 17/3211 463/31
6,896,617 B2 5/2005 Daly
6,960,134 B2 11/2005 Hartl et al.
6,976,915 B2 * 12/2005 Baker ..... G07F 17/32 40/564
7,008,324 B1 * 3/2006 Johnson ..... G07F 17/32 345/156
7,021,795 B2 * 4/2006 Coates ..... H05B 47/155 362/286
7,060,591 B2 * 6/2006 Yamazaki ..... G02F 1/1339 438/457
7,121,945 B2 * 10/2006 Suganuma ..... A63F 13/08 463/34
7,166,029 B2 * 1/2007 Enzminger ..... G07F 17/3211 273/143 R
7,371,170 B2 5/2008 Cregan et al.
7,377,850 B2 5/2008 Shackelford et al.

(56) References Cited

U.S. PATENT DOCUMENTS 7,452,276 B2 * 11/2008 Loose ..... G07F 17/3202 463/20
7,488,252 B2 2/2009 Griswold et al.
7,510,475 B2 * 3/2009 Loose ..... G07F 17/3211 463/16
7,578,735 B2 8/2009 Frizzell et al.
7,625,278 B2 12/2009 Paulsen et al.
7,654,899 B2 2/2010 Durham et al.
7,744,460 B2 6/2010 Walker et al.
7,841,934 B2 11/2010 Gauselmann
8,066,563 B1 11/2011 Schultz et al.
8,147,322 B2 4/2012 Walker et al.
8,342,938 B2 * 1/2013 Paulsen ..... G07F 17/3202 463/20
8,371,929 B2 * 2/2013 Iverson ..... G07F 17/3213 463/20
8,375,033 B2 2/2013 Shpigel et al.
8,388,432 B2 * 3/2013 Mattice ..... G07F 17/3211 463/20
8,388,433 B2 * 3/2013 Stewart ..... G07F 17/3202 463/20
8,393,750 B2 * 3/2013 Clement ..... F21V 21/22 362/198
8,512,121 B2 8/2013 MacVittie et al.
8,545,326 B2 * 10/2013 Underdahl ..... G07F 17/3211 463/42
8,662,984 B2 * 3/2014 Haga ..... G07F 17/3213 463/20
8,864,567 B2 * 10/2014 Underdahl ..... G07F 17/3211 463/20
8,876,605 B2 * 11/2014 Iverson ..... G07F 17/3213 463/37
8,956,215 B2 * 2/2015 Iverson ..... G07F 17/3211 463/20
9,011,233 B2 4/2015 Ryan
9,098,847 B2 8/2015 Basallo et al.
9,098,973 B2 8/2015 Basallo et al.
9,129,488 B2 * 9/2015 Paulsen ..... G07F 17/34
9,165,434 B2 * 10/2015 Stewart ..... G07F 17/34
9,177,447 B2 11/2015 Zoltewicz et al.
9,202,345 B2 12/2015 Zoltewicz et al.
9,430,900 B2 8/2016 Zoltewicz et al.
9,466,169 B2 10/2016 Basallo et al.
9,495,839 B2 11/2016 Aoki et al.
9,595,157 B2 3/2017 Rasmussen et al.
9,633,506 B2 4/2017 Basallo et al.
9,857,972 B2 * 1/2018 Onitsuka ..... G06F 3/0362
9,889,372 B2 2/2018 Sirois et al.
10,762,831 B2 * 9/2020 Winston ..... G07F 17/3251
2001/0031658 A1 * 10/2001 Ozaki ..... G07F 17/3211 463/16
2002/0045474 A1 4/2002 Singer et al.
2002/0142832 A1 * 10/2002 Loose ..... G07F 17/3209 463/30
2002/0175466 A1 * 11/2002 Loose ..... G07F 17/3213 273/143 R
2003/0027624 A1 * 2/2003 Gilmore ..... G07F 17/3211 463/20
2003/0060269 A1 * 3/2003 Paulsen ..... G07F 17/3211 463/20
2003/0060271 A1 * 3/2003 Gilmore ..... G07F 17/3211 463/20
2003/0073484 A1 * 4/2003 Jo ..... A63F 9/24 463/20
2003/0087690 A1 * 5/2003 Loose ..... H04L 67/38 463/20
2003/0104855 A1 * 6/2003 McClintic ..... G07F 17/32 463/16
2003/0130028 A1 * 7/2003 Aida ..... G07F 17/3211 463/20
2003/0134488 A1 * 7/2003 Yamazaki ..... H01L 27/3248 438/455
2003/0190944 A1 * 10/2003 Manfredi ..... G07F 17/3234 463/20
2004/0012145 A1 1/2004 Inoue
2004/0043815 A1 3/2004 Kaminkow
2004/0125601 A1 * 7/2004 Coates ..... H04N 9/315 362/284
2004/0135160 A1 * 7/2004 Cok ..... C23C 14/042 257/88
2004/0229678 A1 * 11/2004 Onuki ..... G07F 17/3211 463/20
2004/0266518 A1 * 12/2004 Gauselmann ..... G07F 17/3211 463/20
2005/0130731 A1 6/2005 Englman et al.
2005/0140088 A1 * 6/2005 Randall ..... G07F 17/3211 273/143 R
2005/0170736 A1 * 8/2005 Cok ..... H01L 51/001 445/24
2005/0192090 A1 * 9/2005 Muir ..... G07F 17/3211 463/30
2006/0142080 A1 6/2006 Enzminger
2008/0108422 A1 5/2008 Hedrick et al.
2008/0182647 A1 7/2008 Courssou et al.
2009/0036208 A1 2/2009 Pennington et al.
2009/0142080 A1 6/2009 Naruse
2009/0181755 A1 7/2009 Gagner et al.
2011/0300937 A1 12/2011 Crowder, Jr. et al.
2012/0220360 A1 8/2012 Kelly et al.
2014/0051496 A1 2/2014 Meyer

* cited by examiner

GAMING MACHINE HAVING PERIPHERAL REELS, A SELECTIVELY TRANSPARENT FRONT DISPLAY, AND MOTOR DRIVEN REELS BEHIND THE FRONT DISPLAY

CROSS-REFERENCE TO RELATED APPLICATIONS

This application is a continuation-in-part of U.S. patent application Ser. No. 16/026,756, filed Jul. 3, 2018, which is a continuation-in-part of U.S. patent application Ser. No. 14/338,792, filed Jul. 23, 2014, now U.S. patent application Ser. No. 10,043,350 issued on Aug. 7, 2018, which claimed priority to US provisional application Ser. No. 61/857,577, filed on Jul. 23, 2013, assigned to the present assignee.

FIELD OF THE INVENTION

This invention relates to gaming machines, such as video slot machines, and, in particular, to a gaming machine that includes a front display, peripheral reels, and stepper motor reels behind the front display, where the front display may be controllable to be transparent to reveal the stepper motor reels or opaque to display symbols or other information. The stepper motor reels may be part of a bonus game triggered by a primary game that is conducted using the front display and the peripheral reels.

BACKGROUND

Conventional reel-type video slot machines accept the player's bet of credits, initiate the spinning of virtual reels, randomly stop the reels to display a final array of symbols, then grant an award to a player based on the occurrence of winning symbol combinations across pay lines and based on the player's initial bet per pay line.

It would be more interesting for the player if an additional secondary game were also played. Ideally, the secondary game would have the potential of awarding very high awards, yet would have a high win frequency for lower value awards. The secondary game should also not take too much time to play and be simple to understand.

SUMMARY

In one example, a video gaming machine displays five center reels with three displayed symbols per reel, forming a 5×3 matrix of symbols. There may be 25 or more different pay lines across the five reels. Surrounding the five center reels are independently spun peripheral scatter symbol reels. Scatter symbols can form winning combinations irrespective of their positions. To form a ring of scatter symbols around the center 5×3 matrix of symbols, where all the symbols are of the same size, 20 peripheral reels are needed. In one embodiment, there are about ten different symbols on the center reels and only three different-type scatter symbols on the peripheral reels. Blanks may also be added to the peripheral reels.

Most of the symbols on the center reels are conventional symbols that are used to create winning combinations across pay lines. At least some of the center reels also include trigger symbols that trigger the secondary game involving the peripheral reels. In one embodiment, the secondary game is triggered by the display of only a single trigger symbol on the center reels. The trigger symbols may also be wild symbols for creating winning symbols combinations on the center reels.

To enhance the player's excitement, the center reels are stopped first so the player can see whether a trigger condition has occurred. Then the peripheral reels are sequentially stopped so the player can focus on the secondary game.

In one embodiment, there are multiple trigger symbol types, such as three types. Each trigger symbol type directly corresponds with a particular type of scatter symbol that can be displayed by the peripheral reels. In one embodiment, each type of trigger symbol is identical to a corresponding scatter symbol on the peripheral reels.

If a trigger symbol of a certain type is displayed on the center reels in the main game, and after an award is granted for the main game, all the same type scatter symbols displayed by the peripheral reels are highlighted, and a bonus award is granted based on how many of that type of scatter symbol is displayed by the peripheral reels.

In one embodiment, all the trigger symbols are only included on the fifth (rightmost) reel, and only one trigger symbol can be displayed at a time. There is at least one type of trigger symbol for each type of scatter symbol on the peripheral reels.

In one embodiment, if multiple different trigger symbols are displayed, two bonus awards are granted, one for each scatter symbol type displayed by the peripheral reels. If two of the same type of trigger symbols is displayed, the bonus award is doubled or otherwise multiplied.

In one embodiment, the image of the trigger symbols is unrelated to the image of the scatter symbols. In that embodiment, a certain combination of the trigger symbols on the center reels triggers the secondary game. The bonus award is based on winning combinations of the scatter symbols on the peripheral reels, in accordance with a displayed paytable.

The scatter symbols may include high value scatter symbols or all equal value scatter symbols. The bonus award may increase non-linearly with the number of matching scatter symbols so that there is a possibility of a very high bonus award. The different trigger symbols and scatter symbols may have different probabilities of occurring (weighted probabilities). As seen, there is a wide range of possibilities in designing the reel strips for the center reels and the peripheral reels which allow the designer to provide for a high bonus win frequency when a trigger symbol is displayed, yet also provide for a low frequency of very high bonus awards. If blanks are also included on the scatter reels, the design flexibility is further increased.

If the secondary game results in no bonus win, a consolation award may be granted.

In another embodiment, after a triggering event, the occurrence of a certain number of the same scatter symbols triggers another bonus game, which may be an interactive game where the player picks certain icons with hidden awards or any other type of special bonus game.

Many different types of games may use the concept of a ring of "single symbol" peripheral reels surrounding conventional center reels, where each peripheral reel is independently spun and stopped, and any bonus award is based on the scatter symbols displayed by the peripheral reels. The secondary game takes very little time to play since it is run concurrently with the main game, and the game is easy to understand.

The game may also be implemented with motorized physical reels as the center reels and/or the peripheral reels. In one embodiment, the center reels are physical reels and the peripheral reels are displayed on one or more display screens.

In another embodiment, motorized center reels are depicted as a 3-dimensional image, or an image that has actual depth, on a special center display, surrounded by a flat display showing the peripheral reels. This clearly distinguishes the center reels from the peripheral reels. In a conventional gaming machine that uses actual physical reels, only a small portion of the reels is shown through a window of the gaming machine to only display a few symbols on each reel, so the 3-dimensional display of the center reels just needs to convey a slight depth or arc to give the illusion that the center reels are physical reels rather than animated reels.

The flat display showing the peripheral reels may have a transparent center area through which the 3-dimensional center display is viewed in order for the gaming machine to have a planar front surface. The screen showing the image of the motorized center reels is set back to give the illusion that the center reels are motor driven.

In one embodiment, the center display comprises a front flat LCD or OLED screen that is transparent and a rear flat LCD or OLED screen behind the front screen. The two screens display different aspects of an image, including motor driven reels, to give the display of the center reels depth. The center reels may have an animated lighting effect that emulates the lighting generated by, or reflected off of, physical reels.

In another embodiment, the center display that displays the image of the motor driven center reels is actually curved to emulate the curve of a physical reel. A large flat screen displaying the peripheral reels may have a center transparent area through which the set-back curved screen is viewed. Since the center screen is set back and curved, the user sees the center reels as having depth.

In another embodiment, the flat screen that displays the peripheral reels has separate transparent windows for each of the center reels, such as five windows. The center display showing the center reels is then set back from the front display of the peripheral reels to give a 3-dimensional effect so the center reels look like actual mechanical reels.

In another embodiment, the gaming machine platform includes a front display, peripheral reels, and stepper motor reels behind the front display, where the front display may be controllable to be transparent to reveal the stepper motor reels or opaque to display symbols or other information. The stepper motor reels may be part of a bonus game triggered by a primary game. The platform may be programmed to play a variety of types of games.

Other variations are described.

BRIEF DESCRIPTION OF THE DRAWINGS

Elements that are the same or equivalent in the various figures are identified with the same numeral.

DETAILED DESCRIPTION

Although the invention can typically be implemented by installing a software program in most types of modern video gaming machines, one particular gaming machine platform will be described in detail.

Figure 1:
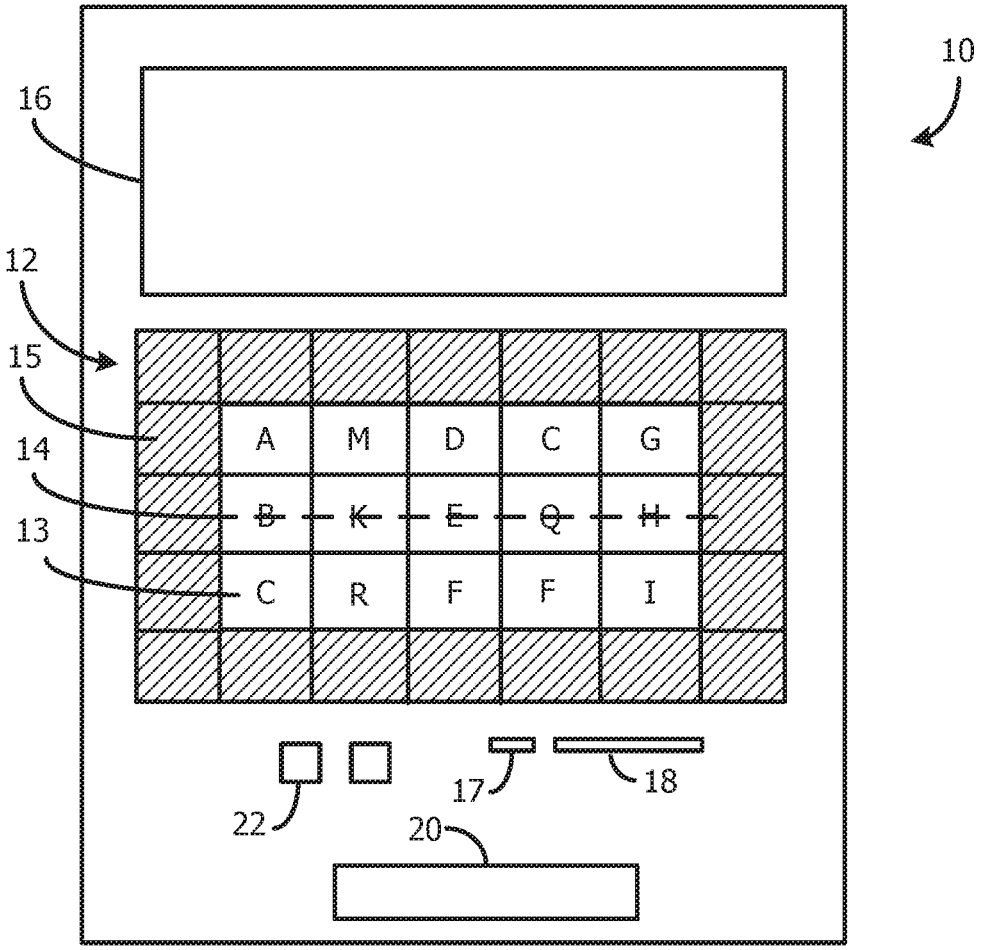
FIG. 1 illustrates a gaming machine that displays a reel-type game on a video screen and is programmed to perform the inventive secondary game.

FIG. 1 illustrates a video gaming machine 10 that incorporates the present invention. The machine 10 includes a bottom display 12 that may be any flat panel color display or any other type of display. In the example shown, the main game shown on the display 12 is the random selection of a 5×'array of symbols on five virtual reels 13, where an award is granted based on the combination of symbols across any number of pay lines, such as the payline 14. The array of symbols may also be a 5×4 array of symbols, a 3×3 array of symbols, or any other size or shape array.

The display 12 also shows a secondary game employing 20 independently spun peripheral reels 15 (or secondary reels), shown cross-hatched. The 20 reels 15 surround the main game reels 13. The symbols displayed on the reels 15 are all scatter symbols since there is no pay line associated with winning combinations of symbols on the reels 15. Surrounding the main game with the ring of "single symbol" reels 15 is an effective and efficient way of displaying the secondary game, since the scatter symbols are easy to comprehend by the player and there needs to be no transition to another game motif to play the secondary game. The secondary game is essentially played concurrently with the main game, so the betting frequency is not significantly slowed by the secondary game.

There may be any number of the peripheral reels 15, but the arrangement shown in the figures is the most aesthetically pleasing, and providing 20 reels 15 offers a wide range of symbol selection probabilities in the secondary game.

A top display 16 is an optional video screen that may display a bonus game, or the paytable, or the game's theme, or any other information. The display 16 may instead be backlit painted glass. The top display 16 may also be an extension of the display 12.

A coin slot 17 accepts coins or tokens in one or more denominations to generate credits within the machine 10 for playing games. An input slot 18 accepts various denominations of banknotes or machine-readable tickets, and may output printed tickets for use in cashless gaming. A coin tray 20 receives coins or tokens from a hopper upon a win or upon the player cashing out. Player control buttons 22 include any buttons needed for the play of the particular game or games offered by machine 10 including, for example, a bet button, a spin reels button, a cash-out button, and any other suitable button. Buttons 22 may be virtual touch screen buttons.

In the below scenario, it is assumed that the software program for playing the inventive game is installed in a standalone gaming machine. However, the program may be downloaded to any processing device using a display screen for playing the game. The credits bet may represent a monetary amount (such as for a casino game) or a non-monetary amount (such as where the game is played solely for amusement), and any award may represent a monetary amount or a non-monetary amount.

Figure 2:
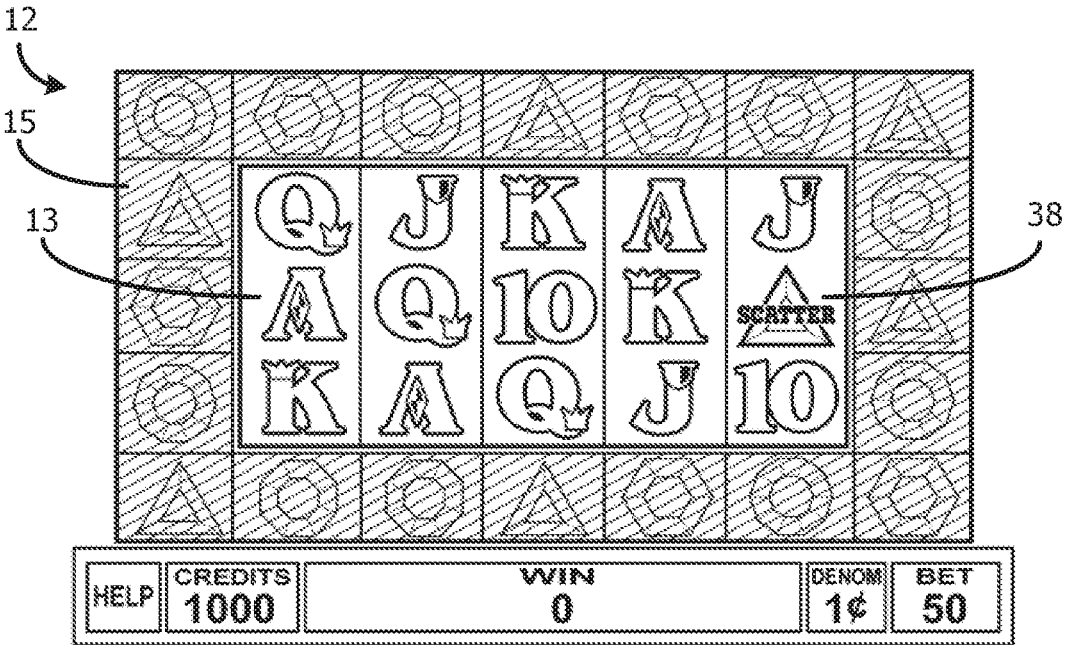
FIG. 2 is a simulated screen shot after five center reels and 20 peripheral reels have been randomly stopped.
Figure 3:
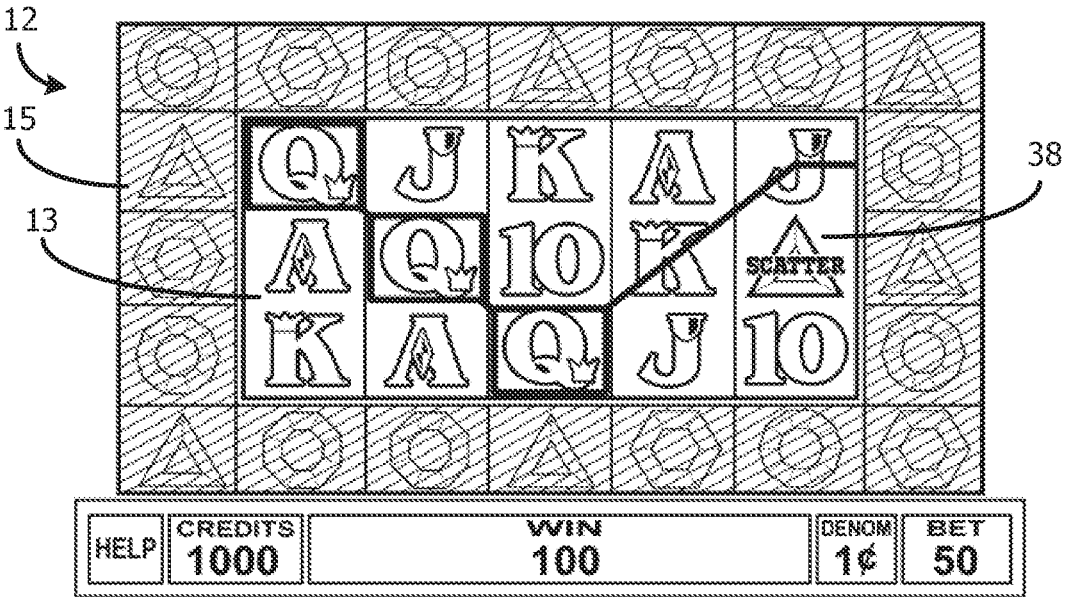
FIG. 3 illustrates a winning symbol combination in the center reels being highlighted and an award granted for the winning symbol combination.
Figure 4:
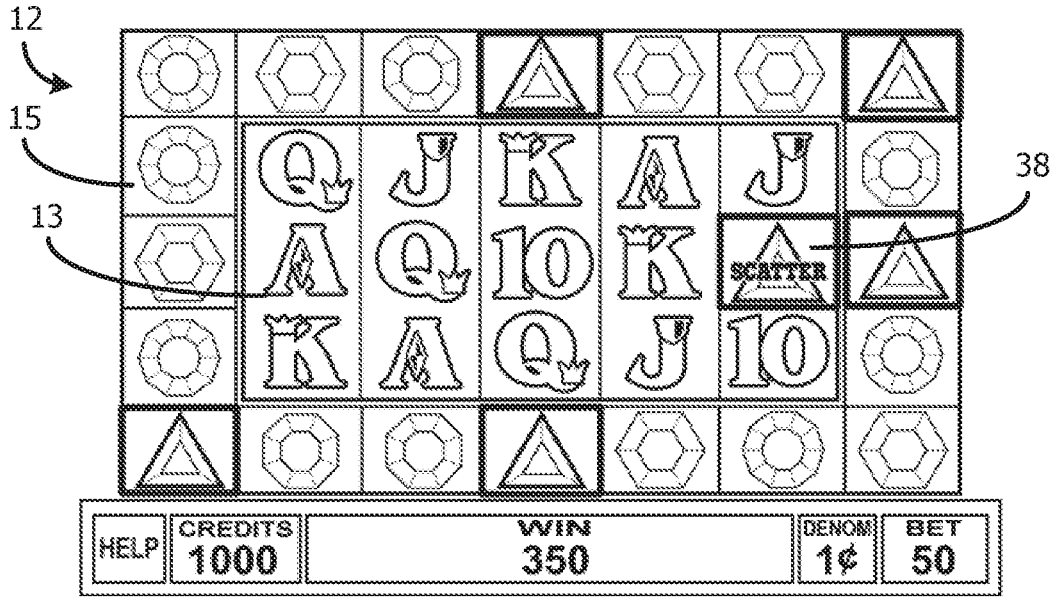
FIG. 4 illustrates how the occurrence of a trigger symbol in the center array of symbols caused the peripheral reels to be highlighted and relevant scatter symbols being identified for granting a bonus award.

FIGS. 2-4 show more detailed images displayed on the display 12 for a single game. The description of the game will also reference the flowchart of FIG. 5.

Figure 5:
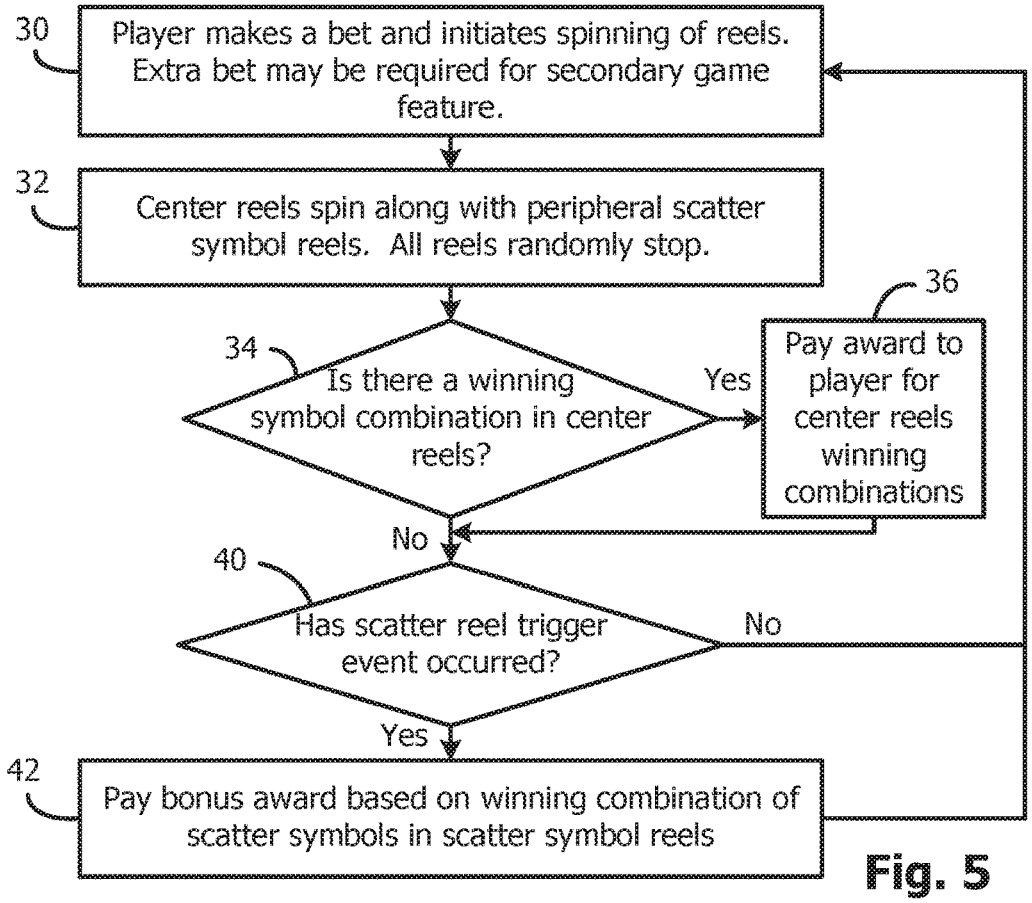
FIG. 5 is a flowchart identifying various steps performed in accordance with an embodiment of the invention.

In step 30 of FIG. 5, the player makes a bet. FIG. 2 illustrates that the player has a bank of 1000 credits and has made a bet of 50 credits (two cents per pay line). In one embodiment, the player has to make a special added bet to activate the secondary game.

This added bet may be used to fund the secondary game if the paytable for the main game is to be unaffected by the addition of the secondary game.

In step 32, the player then presses a button to simultaneously spin all the center reels 13 and all the peripheral reels 15. A pseudo-random number generator in the gaming machine 10, which may be a subroutine running on the machine's CPU, determines the stopping position of each of the center reels 13 and each of the peripheral reels 15. A software routine animates the reels spinning and stops the reels in sequence starting from the leftmost one of the center reels 13. The peripheral reels 15 are then stopped in sequence starting from the top left peripheral reel and going around the ring so the player can better focus on the unfolding secondary game.

The resulting stopped display is shown in FIG. 2. In FIG. 2, the peripheral reels 15 are darkened to focus attention on the center reels 13. In an actual embodiment, this may not be the case, and the scatter symbols are the type that are very distinguishable from the symbols on the center reels 13 to easily distinguish the two types of symbols. In FIG. 2, the scatter symbols have a gem theme, while the center symbols have a playing card theme.

The award for the center array of symbols is first determined.

In step 34, the CPU determines if there is a winning combination of symbols on the center reels 13 in the 5×'array.

FIG. 3 illustrates that there is a winning combination of symbols (three Queens) along the illustrated pay line.

In step 36, the player is granted an award for the three Queens based on a paytable. Note that there is a secondary game trigger symbol 38 that was displayed on the rightmost center reel 13. This trigger symbol 38 (having a gem theme) acts as a wild symbol for symbols on the same pay line, but no winning combinations occurred using the wild symbol in the example. FIG. 3 illustrates that the player has been awarded 100 credits for the three Queens.

In step 40, it is determined by the CPU whether there is a trigger condition for playing the secondary game. In the embodiment shown, there are only trigger symbols 38 on the rightmost reel 13 so that only one trigger symbol 38 at a time can appear on the display 12. However, in other embodiments, the trigger symbols for the secondary game are on multiple reels, and the trigger condition may be the display of three or more trigger symbols 38. In another embodiment, the occurrences of trigger symbols 38 may be saved from game to game, and the secondary game is only triggered when a sufficient number of trigger symbols 38 have been accumulated. Other variations of the trigger condition are contemplated.

Since, in step 40, it has been determined that the trigger condition exists, attention is now drawn to the peripheral reels 15. This may be done with an animation. In the example, there are three possible scatter symbols, a circular gem, a hexagonal gem, and a triangular gem. The trigger symbols on the rightmost reel 13 also include a circular gem, a hexagonal gem, and a triangular gem. When one of the trigger symbol types 38 is displayed on the center reels 13, the same type gem symbols are highlighted on the peripheral reels 15. In the example, the trigger symbol 38 is a triangular gem symbol, and five triangular gem symbols are highlighted on the peripheral reels 15.

There is a paytable for the secondary game that associates the number of highlighted symbols with a particular award. The more highlighted symbols, the greater the award. Therefore, after the player initially sees the triangular gem trigger symbol 38 appear followed by the sequential stopping of the peripheral reels 15, the player is able to see the significance of the various reels 15 stopping on a triangular gem symbol. This order of stopping the various reels 13 and 15 maximizes player excitement since the player already knows the importance of achieving a particular scatter symbol.

In one embodiment, all the scatter symbols have the same value and there is no weighting of the scatter symbol pseudo-random selection. Similarly, the different trigger symbols have equal probabilities of occurring. In another embodiment, however, some scatter symbols are more valuable than others and the probabilities of the display of certain trigger symbols or the scatter symbols are weighted, such as by the arrangements of the various symbols on the reel strips.

In the example shown, each peripheral reel 15 has an equal number of each type of gem symbol on its reel strip. In another embodiment, there may also be blank symbol positions on the peripheral 15 that have no value.

In step 42, the player is granted an award for winning combinations of scatter symbols on the peripheral reels 15. Since there is no payline for the secondary game, the symbols are referred to as scatter symbols. FIG. 4 illustrates that the player was granted a bonus win of 250 extra credits for the five triangular gem symbols on the peripheral reels 15. There may be a minimum number of the same type of scatter symbol needed for a winning combination of scatter symbols.

The game then ends, and the flowchart goes back to step 30.

The concept of peripheral reels 15 surrounding a main game may be applied to any main game, where the main game triggers a secondary game involving the scatter symbols on the peripheral reels 15.

In another embodiment, trigger symbols are on multiple ones of the center reels 13, and the trigger symbols only serve to trigger the secondary game. For example, if three trigger symbols are obtained in the main game, the secondary game is played. The trigger symbols may be wild symbols for the main game. In this embodiment, the trigger symbols do not identify the relevance of any particular scatter symbol. The combinations of the various types of scatter symbols on the peripheral reels 15 are then cross-referenced to a paytable to identify a bonus award. In such an embodiment, the pseudo-random selection of the scatter symbols may be weighted so that higher value symbols are displayed less often.

In another embodiment, multiple center reels 13 have different trigger symbol types, and the display of each type of trigger symbol causes the secondary game to grant awards based on the same symbol types occurring in the peripheral reels 15. For example, the center reels 13 may display a triangular gem symbol and circular gem symbol. In such a case, the bonus award can be based on the number of triangular gem symbols and circular gem symbols occurring on the peripheral reels 15.

In another embodiment, there may be one or more trigger symbols on one of the center reels 13, such as the fifth reel, and the display of the trigger symbol results in the combination of symbols on the peripheral reels 15 being evaluated in any way by a paytable for determining the bonus award. The paytable may be similar to the paytable for the main game, but with different symbols, where different combinations of the different gem symbols are associated with different awards.

In another embodiment, the peripheral reels 15 only have blank positions and the same scatter symbol type, such as a single gem symbol. When a trigger condition occurs in the main game, the number of displayed scatter symbols determines the bonus award.

Man other variations are contemplated.

If there are no winning scatter symbol combinations, the player may be granted a consolation prize.

In another embodiment, a particular combination of the scatter symbols triggers another bonus game, such as a player-selection type game with a potentially high award. One such bonus game may present the player with an array of icons with hidden award values or award multipliers, and the player touches the icon(s) until the game is terminated. Any other bonus game is contemplated.

Figure 6:
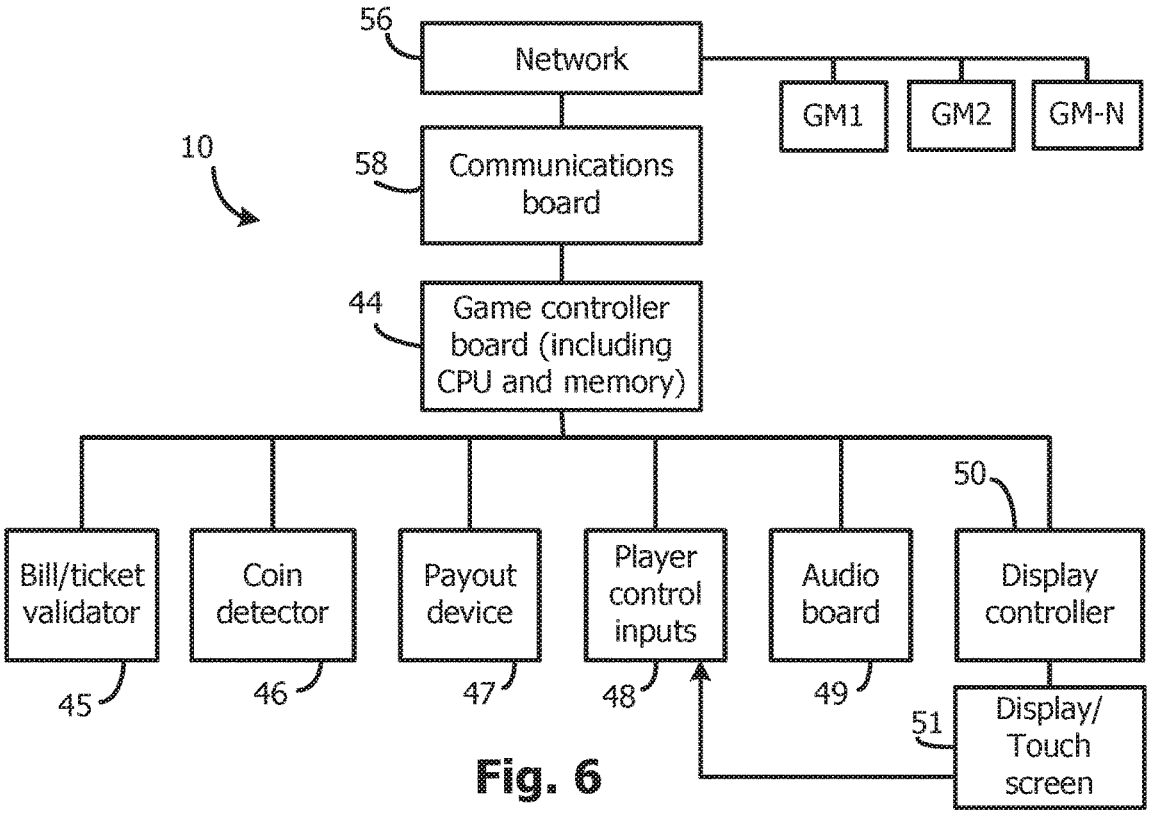
FIG. 6 is a block diagram of certain functional components in the programmed gaming machine of FIG. 1 and illustrates a network connected to linked gaming machines.

FIG. 6 illustrates basic circuit blocks in the machine 10 of FIG. 1. A game controller board 44 includes a processor (CPU) that runs the gaming program (including the secondary game) stored in a program ROM, such as a CD. The program ROM may include a pseudo-random number generator program for selecting symbols and for making other random selections. At least the active portion of the program is stored in a RAM on the board 44 for access by the processor. A pay table ROM on the board 44 detects the outcome of the game and identifies awards to be paid to the player. A bill/ticket validator 45 and coin detector 46 add credits for playing games. A payout device 47 pays out an award to the player in the form of coins or a printed ticket at the end of a game or upon the player cashing out. Player control inputs 48 receive push-button or touch-screen inputs for playing the game. An audio board 49 sends signals to the speakers. A display controller 50 receives commands from the processor and generates signals for the various displays 51. The touch screen portion of the displays 51 provides player selection signals to the processor.

The game controller board 44 transmits and receives signals to and from a network 56 via a communications board 58. The network 56 includes servers and other devices that monitor the linked gaming machines 10 and GM1-GM-N and provide communications between the machines 10 and GM1-GM-N.

The present invention may also be applied to a slot machine having physical, motorized reels in the center area, where the surrounding array of scatter symbols is either displayed on one or more video screens or is composed of physical reels themselves. The resulting display area will still resemble that of FIG. 2.

FIGS. 7-11 are directed to using separate displays for an image of center mechanical reels and an image of the peripheral reels. The image of the mechanical reels is provided on a display that is set back from the display of the peripheral reels to convey depth so as to roughly create the illusion of actual mechanical reels. Note that, although mechanical reels are round, only a small portion of the reels needs to be visible to a player. Thus, the illusion of only a small arc is needed to covey mechanical reels. This may be enhanced using an animated lighting effect in the set-back display.

Although the examples show only three reels for simplicity, any number of reels may be employed, such as five, and any number of vertical symbols may be shown on a reel, such as up to five.

Figure 7:
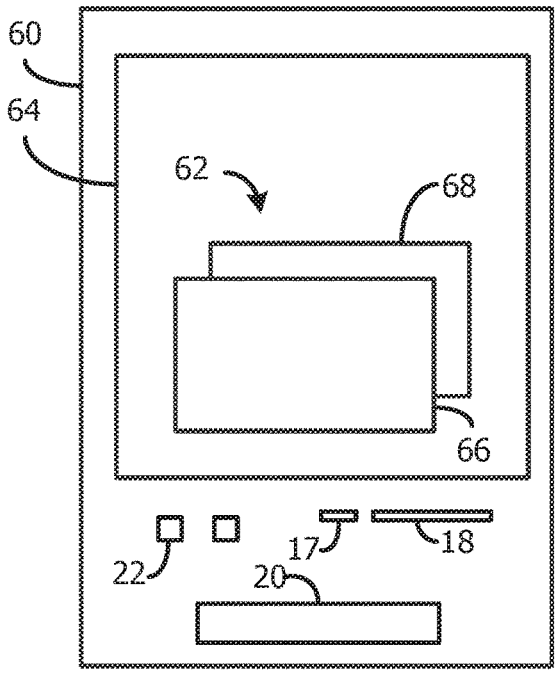
FIG. 7 illustrates a gaming machine with a center display and a separate peripheral display, where the center display comprises two LCD or OLED screens depicting different images to give the center display depth to emulate physical center reels.

FIG. 7 illustrates a gaming machine 60 with a center display 62 and a separate peripheral reel display 64, where the center display 60 comprises a transparent front screen 66 (LCD or OLED) and a rear screen 68. If the screens 66/68 are LCDs, they share the same backlight. The two screens 66/68 depict different images to give the center display depth to emulate mechanical center reels. As an example, the set-back rear screen 68 may display the center reels with a realistic lighting effect to make the reels appear to have an arc. The front screen 66 may display pay lines across the reels, framing, and/or other information. Also shown are the various slots, etc. described with respect to FIGS. 1 and 6. The routine performed by the gaming machine's processor may be the same as described with respect to FIG. 5 and the other embodiments.

Figure 8:
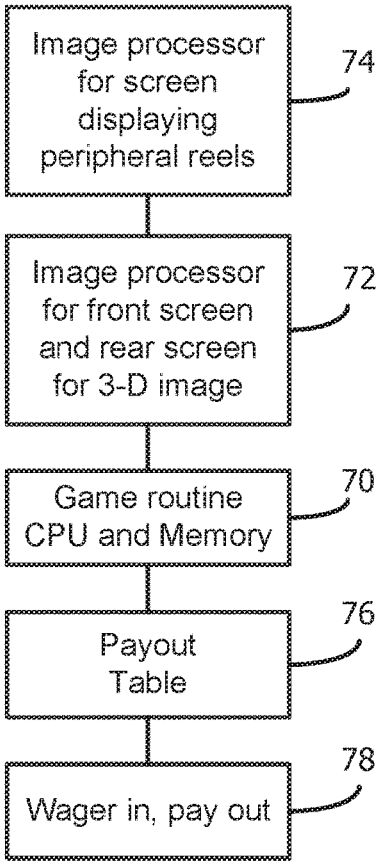
FIG. 8 illustrates certain functional units in the gaming machine of FIG. 7.

FIG. 8 illustrates certain functional units in the gaming machine of FIG. 7. A game routine CPU and memory 70 run the game software. A first image processor 72 processes the different image signals for the front and rear screens 66/68 for the center reels, and a second image processor 74 processes the image signals for the separate peripheral display 64. In one embodiment, the center reel display and the peripheral reel display are independently controlled, based on signals from the game routing CPU, since the two displays may have different operating requirements. A payout table memory 76 determines the player's winnings after a game, and a wager in/pay out system 78 detects the wagers and provides the pay outs to the player.

Figure 9:
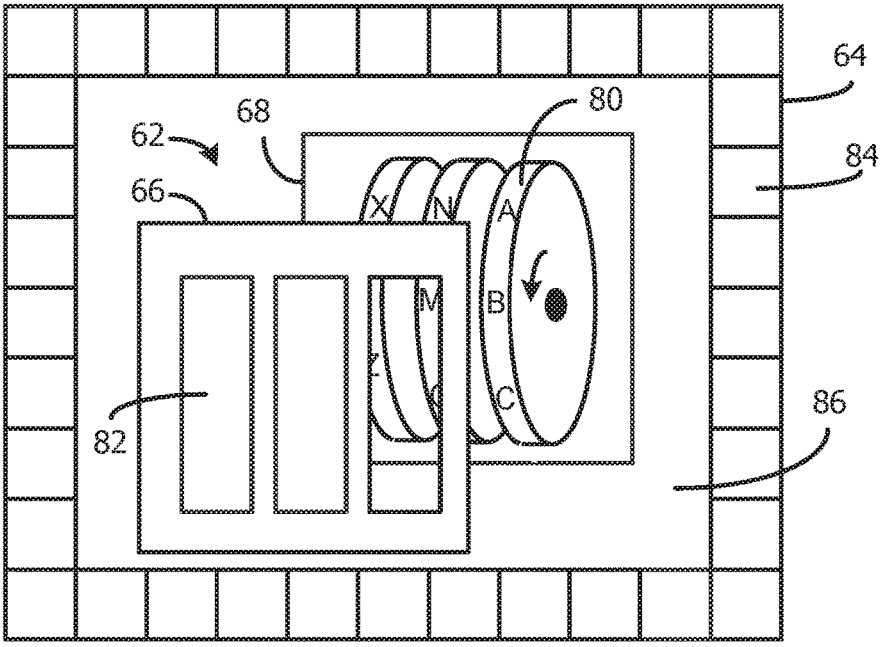
FIG. 9 is an example of the two screens displaying the center reels to convey depth to the player, where a separate large flat screen for the peripheral reels surrounds the center display.

FIG. 9 is an example of the two screens 66/68 in FIG. 7 displaying the center reels 80 (to emulate mechanical reels)

on the rear screen 68, with suitable animated lighting effects, and displaying windows 82 on the front screen 66. The rear screen 80 may be set back some distance, such as an inch or more, to emulate the placement of physical reels in a conventional "stepper" gaming machine. Since the front screen 66 is transparent where the "off"-pixels are, the image displayed on the front screen 66 can emulate windows typically formed by painted glass in a conventional stepper machine.

A separate, large flat peripheral reel display 64 conveys the peripheral reels in each of the reel positions 84. The display 64 may be LCD, OLED, or other suitable display. The center portion of the display 64 may be a transparent glass window 86 to protect the center display 62 and to provide a planar surface.

In another embodiment, during a primary game, the windows 82 displayed on the front screen 66 show at least three vertically aligned symbols on each reel. During a secondary game, the front screen 66 is controlled to display a window around each individual symbol so each symbol can be depicted as an independent reel that spins independently of all other reels. In the example of FIG. 9, the windows 82 would be segmented to show nine independent reels.

A similar change in animated windows may be performed if the display for the peripheral reels extended in front of the center reels display and displayed a center window through which the set back center reels display was viewed. The peripheral reels display could display windows to show each reel in the center display as having three or more vertical symbols. In a bonus game, the peripheral reel display can display windows that segment the center reels into nine or more independently driven center reels.

Figure 10:
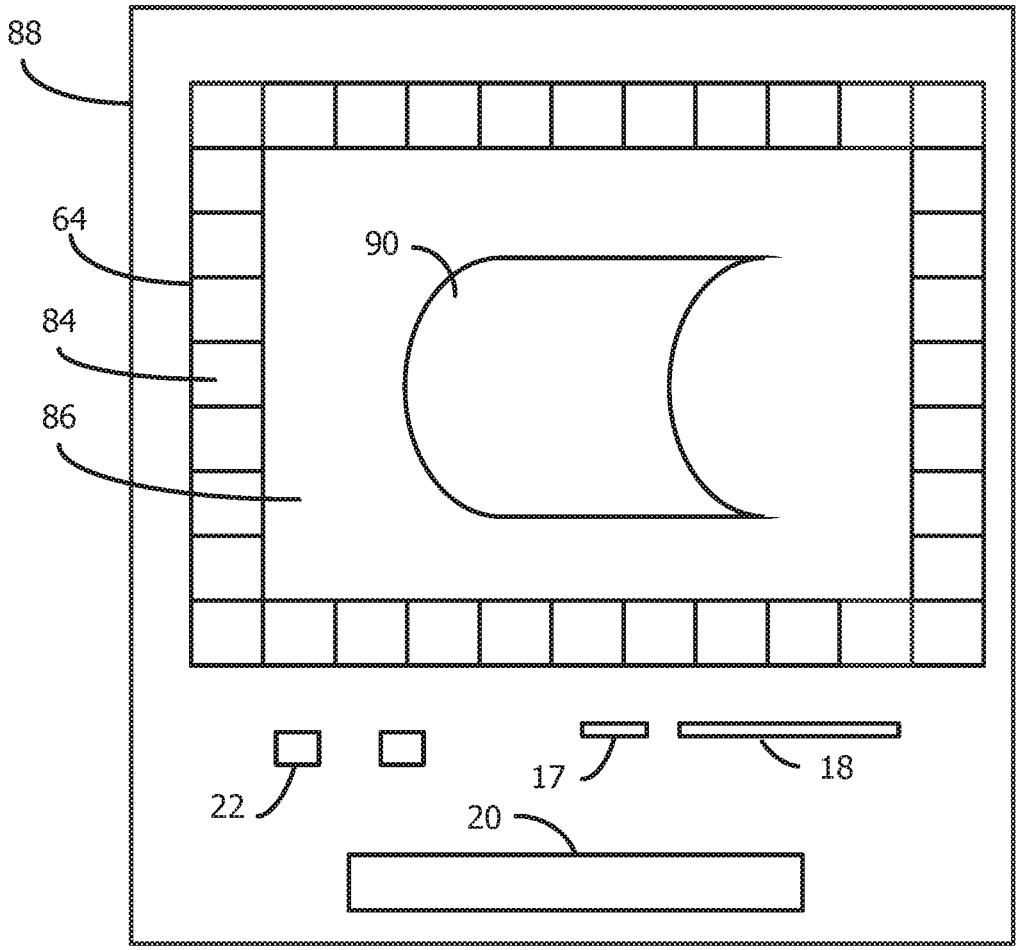
FIG. 10 illustrates how the center reels may be displayed on a separate curved screen which is viewed through a transparent window of the flat screen displaying the peripheral reels.

FIG. 10 illustrates another embodiment of a gaming machine 88 that displays the center reels on a separate curved screen 90 which is viewed through a transparent window 86 of the flat peripheral reel display 64. The curved screen 90 may be a flexible OLED or LCD screen that displays the center reel animation. This gives a 3-dimensional depiction of mechanical reels. The curved screen 90 is set back to emulate the position of actual reels in a conventional stepper machine. The transparent window 86 of the peripheral reel display 64 protects the curved screen 90.

Figure 11:
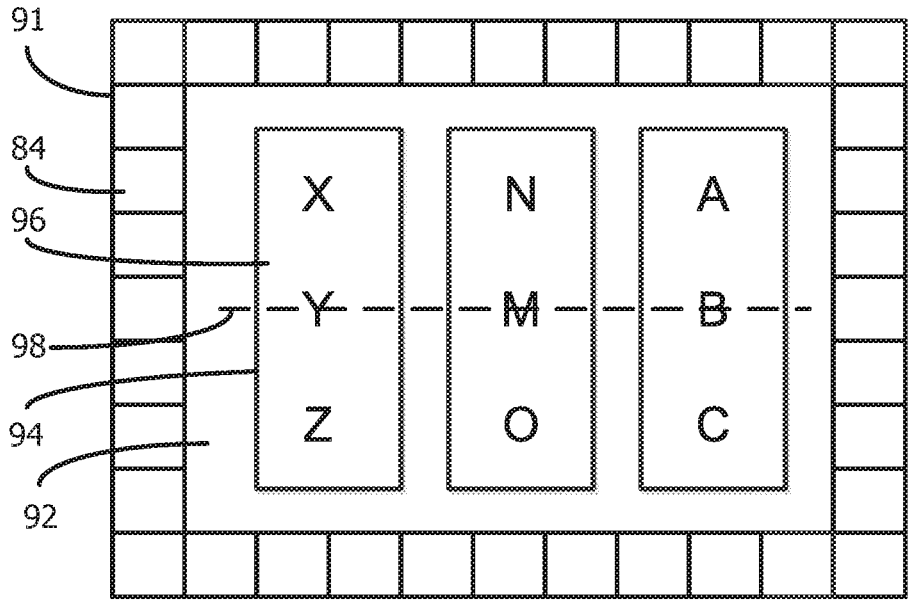
FIG. 11 illustrates an embodiment where the flat screen that displays the peripheral reels has a separate window for each center reel image, and where the center reels are displayed on a separate display screen that is set back to give the illusion of mechanical reels.

FIG. 11 illustrates an embodiment where the peripheral reel display 91 also displays an opaque portion 92 surrounding transparent windows 94 ("off" pixels) for viewing a second display 96 that is set back and displays the center reels. The set-back gives the illusion that the displayed center reels are motor driven reels. The display 91 may also animate any pay lines 98 across the center reels.

An autostereoscoptic display may also be used for the center reels to provide a 3-dimensional effect.

Figure 12:
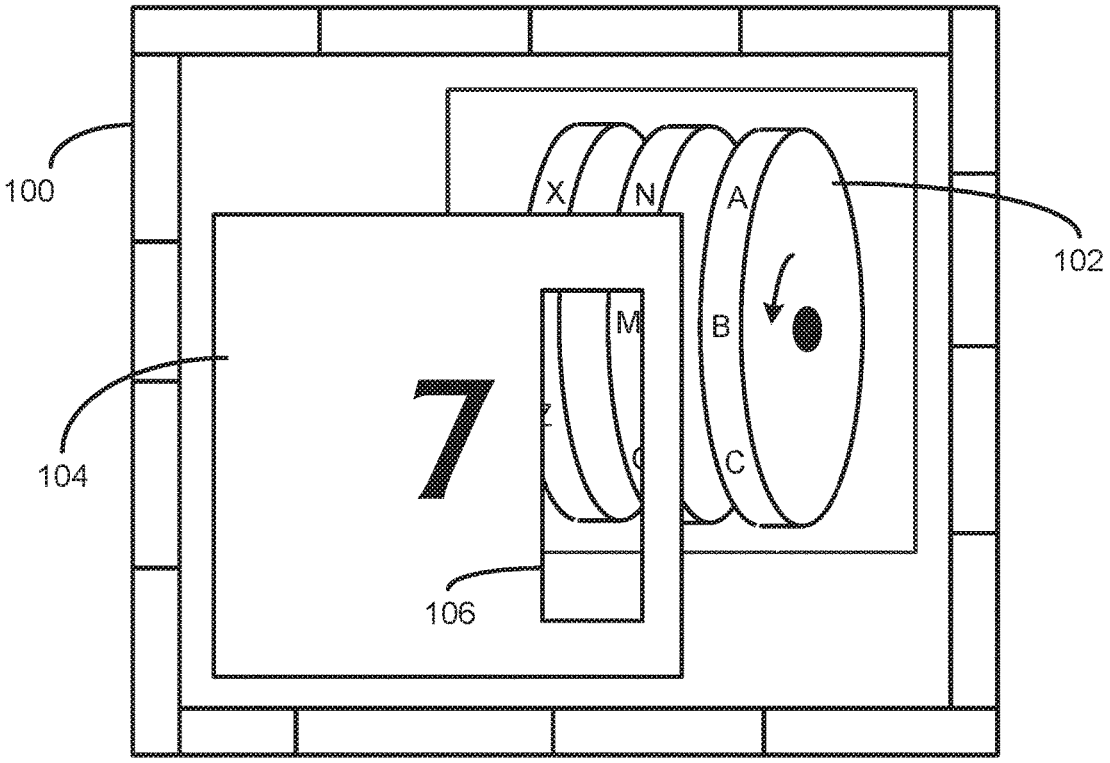
FIG. 12 illustrates the display portion of a gaming machine platform, where the gaming machine includes a front display, peripheral reels, and stepper motor reels behind the front display, where the front display may be controllable to be transparent to reveal the stepper motor reels or opaque to display symbols or other information.

FIG. 12 illustrates the center display area of a gaming machine along with the sixteen peripheral reels 100, similar to FIG. 9, but where physical stepper motor reels 102 are behind a front display 104. The stepper motor reels 102 may be conventional. The front display 104 is shown with a transparent opening 106 to illustrate how the front display 104 can be selectively controlled to be opaque, to display symbols, or transparent to display the rear stepper motor reels 102. Such selectively opaque flat display panels are known and may be a liquid crystal display panel.

In one embodiment, the front display 104 is controlled to be opaque and display one or more symbols in a primary game. For a bonus game, the front display 104 is controlled to be transparent to reveal the stepper motor reels 102 for the bonus game. The front display 104 may display pay lines and other information for the bonus game. A unique advantage to such a system is that the virtual reels displayed on the front display 104 can display any types of symbols and present any odds for winning symbol combinations. With a separate stepper motor reel display, all different symbols with different odds of winning can be presented to the player. In a conventional stepper motor reels gaming machine, the player must play the primary game and bonus game using the same physical reels, which greatly limits the possibilities for a bonus game.

Further, the revelation of the stepper motor reels 102 in response to a trigger condition in the primary game creates an exciting introduction to the bonus game.

In the primary game, the peripheral reels 100 may display scatter symbols or symbols whose positions are important. The front display 104 may display a random arrangement of symbols that can be combined with symbols on the peripheral reels 100 along pay lines, or the peripheral reels 100 may display scatter symbols whose positions are irrelevant but may be combined with the symbols on the front display 104.

In one embodiment, all the peripheral reels 100 may be displayed on a single peripheral display screen or on sixteen separate display screens. In one embodiment, the peripheral reels 100 and the front display 104 are part of the same large display screen, and different areas of the single screen are controlled to display the peripheral reels and the symbols on the front display 104. In that embodiment, the center area of the large display screen can be controlled to be transparent during the bonus game.

In another embodiment, for the primary game, the stepper motor reels 102 are initially visible and may trigger a bonus game along with awards. During the bonus game, the peripheral reels 100 may provide scatter symbols as previously described. When the bonus game is triggered, the front display 104 becomes opaque and a bonus game is played either solely on the front display 104 or on the front display 104 in conjunction with the peripheral reels 100.

Figure 13:
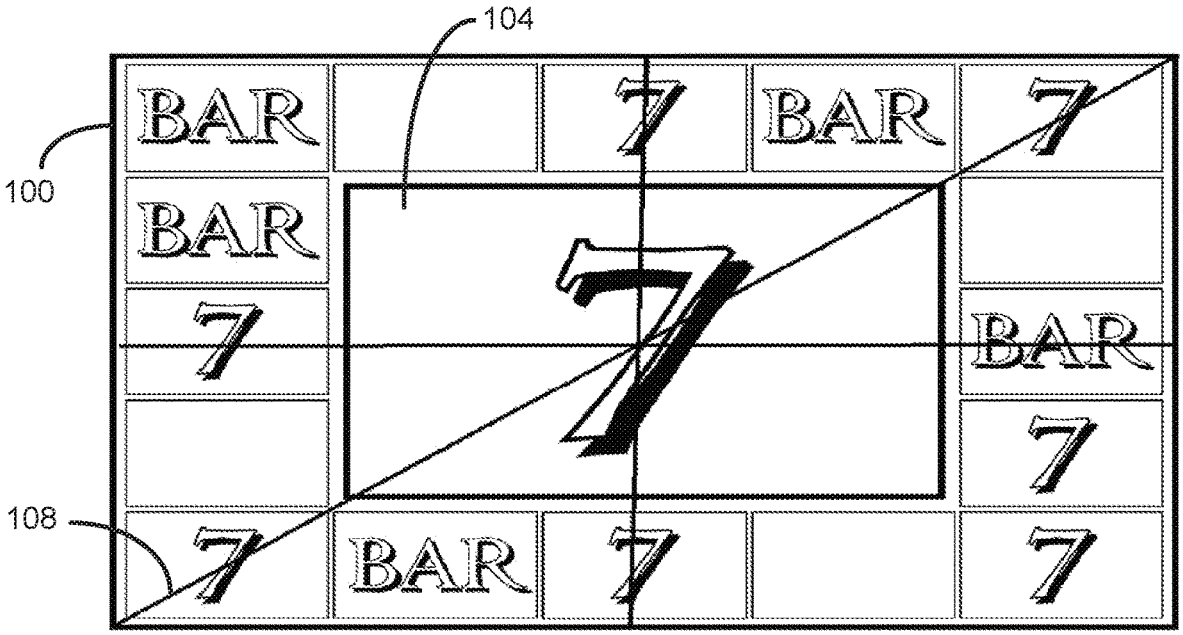
FIG. 13 illustrates a game played on the gaming machine platform of FIG. 12.

FIG. 13 provides an example of one programmed game that can be displayed on the hardware platform of FIG. 9 or 12. In the example of FIG. 13, the front display 104 displays only large single symbols as the virtual reel rotates. In the example, the virtual reel randomly stopped on the 7 symbol. At the same time, the peripheral reels 100 rotate and randomly stop to display other symbols. Such symbols on the peripheral reels 100 may be scatter symbols, or their symbol positions are relevant. In the example of FIG. 13, the peripheral reel symbols are not scatter symbols, and the combination of symbols along pay lines determines the award to the player. The pay lines may be any combination of vertical, horizontal, and diagonal lines that extend through the front display 104, so that there are three symbols (including blanks) along each pay line.

Some pay lines 108 are shown in FIG. 13, and such pay lines 108 (or only the winning pay lines) may be highlighted by the front display 104 and/or the peripheral reel display. As previously mentioned, the front display 104 and the peripheral reel display may be part of the same single display screen. In the example, three 7's results in a win or a bonus game trigger.

Figure 14:
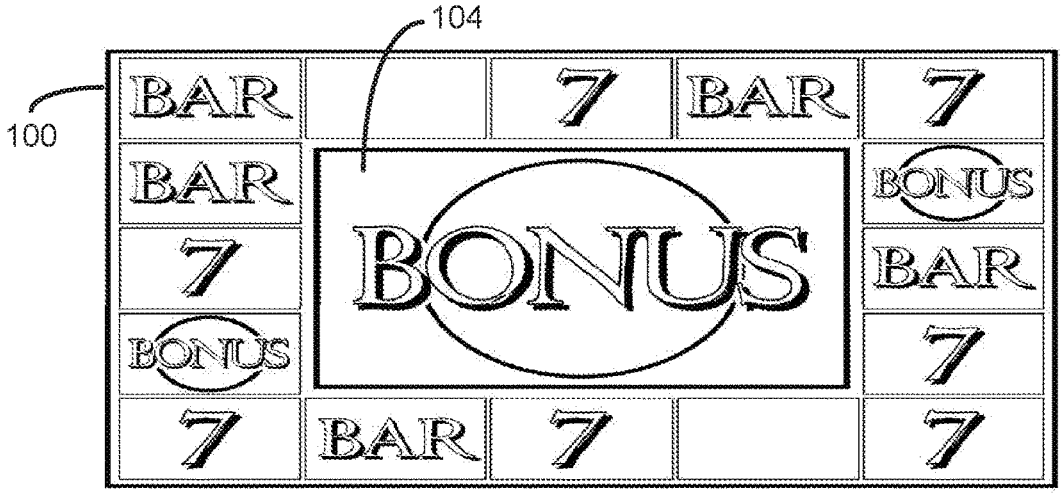
FIG. 14 illustrates a different outcome of the game played on the platform of FIG. 12.

FIG. 14 illustrates one possible reaction to a bonus game trigger in the primary game. After any awards are granted during the primary game, the front display 104 may identify a bonus game has been won and then become transparent to reveal the stepper motor reels. The stepper motor reels then spin and randomly stop to identify a bonus award. The bonus game may also be in conjunction with any symbols displayed on the peripheral reels 100.

FIG. 14 may instead represent a primary game where the front display 104 has randomly selected a large bonus symbol, and two bonus scatter symbols have been displayed on the peripheral reels 100. If three bonus symbols create a trigger condition for a bonus game, the front display 104 becomes transparent to reveal the stepper motor reels for playing the bonus game.

In another embodiment, the center symbol on the front display 104 can be a scatter symbol that is combined with symbols on the peripheral reels 100 to create winning combinations, including a bonus trigger.

Figure 15:
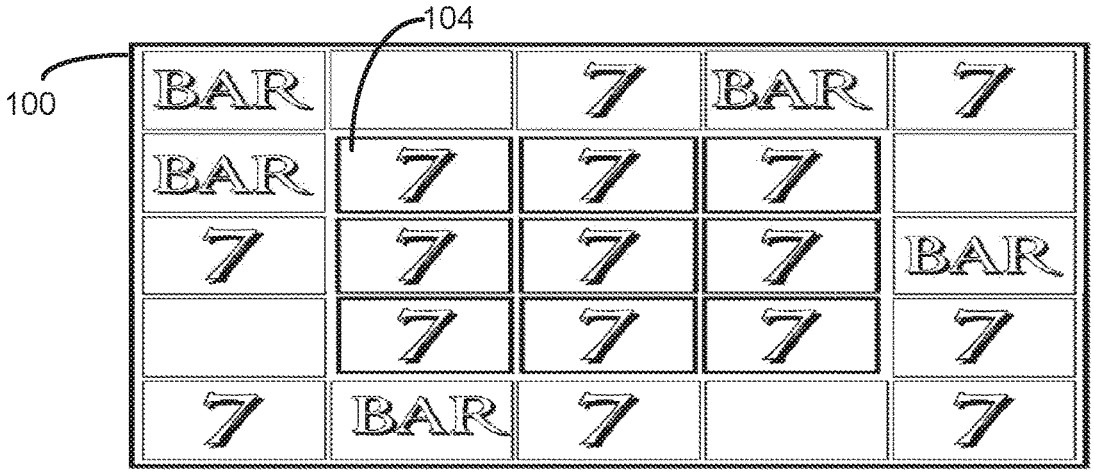
FIG. 15 illustrates a game where the front display or the stepper motor reels presents a 3×3 array of randomly selected symbols.
Figure 16:
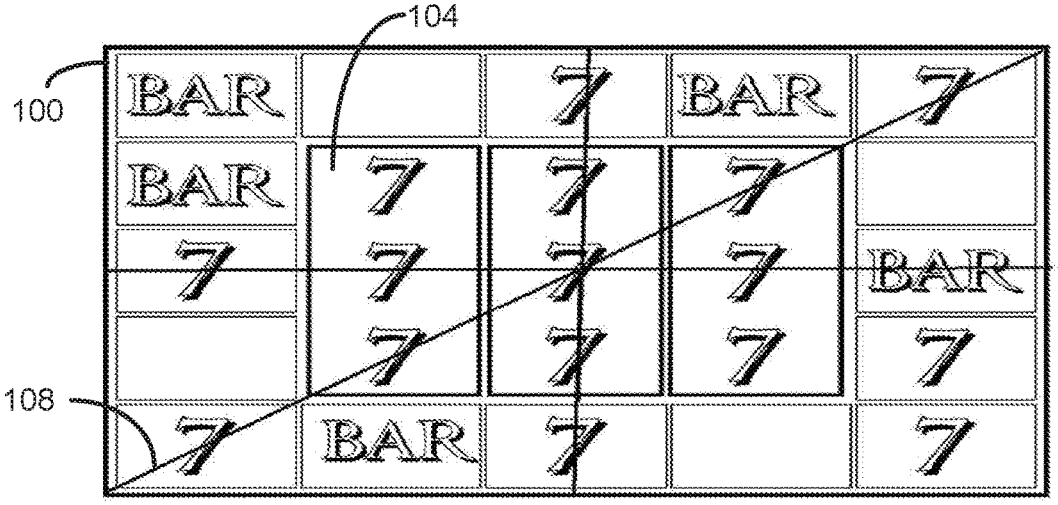
FIG. 16 identifies the winning symbol combinations in FIG. 15.

FIGS. 15 and 16 illustrate an embodiment where the front display 104 emulates an array of nine reels or three vertical reels with three symbols per reel. The selected symbols are then combined with the symbols on the peripheral reels 100 to award prizes or a bonus game.

In the example of FIGS. 15 and 16, four 7 symbols qualify for an award. The player has achieved three sets of four or more 7 symbols, and the winning pay lines 108 are highlighted by the front display 104 and the peripheral reel display.

As previously mentioned, the primary game may be played on the stepper motor reels (while the front display 104 is transparent), and the bonus game may involve the front display 104. In such a case, the center display of the nine symbols may be on the stepper motor reels. Typically, there would not be identical vertically adjacent symbols on a physical reel.

In another embodiment, all games are played on the stepper motor reels and the peripheral reels, and the front display 104 is used to display other information, such as pay lines or information about a win.

One type of primary game may be a Keno game, where the player is initially allowed to select a subset of numbers from a pool of numbers. Then, the peripheral reels 100 are spun and stopped (e.g., sequentially) to reveal numbers randomly selected from the pool. If the player wins, an award is granted and the front display 104 becomes transparent to reveal the stepper motor reels for a bonus game. The front display 104 may be a touch screen that allows the Keno player to select numbers from a grid and highlights the selected numbers during the Keno game. The matching numbers that were selected may then be further highlighted on the front display 104.

In another type of game played on the gaming machine platform, the peripheral reels may act like a spinning wheel type game, where symbols are sequentially illuminated around the center display. The sequence then stops to highlight a single symbol in the peripheral reels, and this serves as an award or a trigger for playing a game on the front display or the stepper motor reels.

Many other games may be played on the inventive gaming machine platform described that involve peripheral reels, a center front display, and physical stepper motor reels that are revealed by the front display in a transparent mode. The peripheral reels and front display may be part of a single display screen that can be made selectively transparent. The game controller 44 in FIG. 6 can be programmed to play any type of game on the platform of FIG. 9 or 12.

Figure 17:
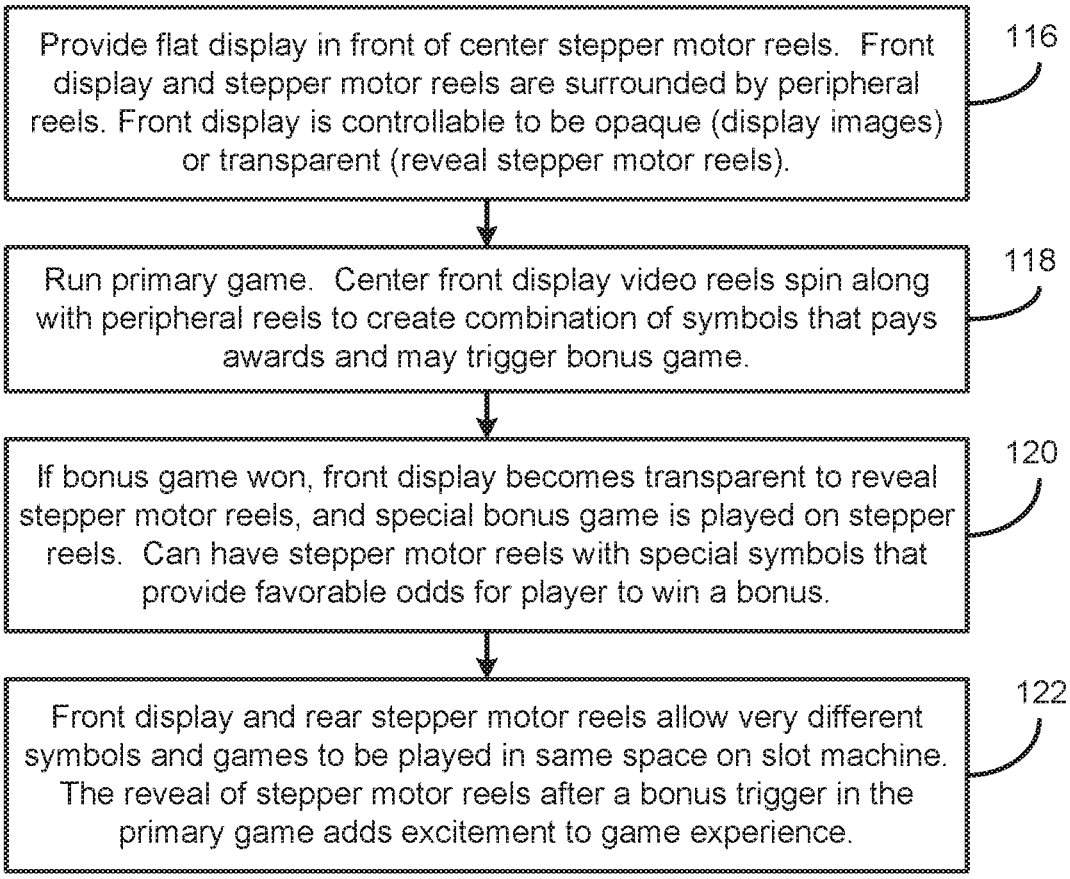
FIG. 17 is a flow chart identifying certain possible features of the gaming machine platform of FIG. 9 or 12.

FIG. 17 is a flow chart identifying various steps in playing the gaming machine of FIG. 12 and other embodiments with physical stepper motor reels. In step 116, the gaming machine platform is provided that includes a center front display, peripheral reels, and physical stepper motor reels that are revealed by the front display in a transparent mode. The front display may display symbols in an opaque mode.

In step 118, the front display is controlled to act as a single reel or multiple reels to play a primary game (or a secondary game) in conjunction with the peripheral reels.

In step 120, if a bonus game is won, the front display becomes transparent to reveal the physical stepper motor reels, and the stepper motor reels are involved in the bonus game.

In step 122, the designer of the game can use the inventive game machine platform to create very different combinations of symbols in the primary game and bonus game, even though the symbols on the stepper motor reels are fixed on printed reel strips. The revelation of the stepper motor reels in response to a bonus game trigger condition adds excitement to the game.

In another embodiment, the stepper motor reels are replaced with another display screen that is set back to give the illusion of physical reels.

The peripheral (secondary game) reels do not need to completely surround the center (primary game) reels. For example, the peripheral reels may just be provided along the top and sides of the center reels to partially surround the center reels. This allows other information to be presented below the center reels.

Any symbols can be displayed on the peripheral reels to carry out any secondary or primary game. The peripheral reels may include symbols that grant a special bonus game that is carried out by the center reels. The symbols may include award values.

The various features in the embodiments may be combined in any suitable manner.

The game may be carried out on a stand-alone machine, or on a machine connected to a server.

The term "random" as used herein includes both pseudo-random and purely random.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A gaming device comprising:

physical, motor driven reels;

a front display in front of the motor driven reels, the front display being controllable to be opaque and display symbols or other information in a first mode of operation or to be transparent to reveal the motor driven reels behind the front display in a second mode of operation;

one or more peripheral displays for displaying a set of secondary reels that surrounds the front display on at least three sides of the front display;

at least one computer programmed to control the front display to be opaque and display the symbols or the other information in the first mode of operation or to be transparent to reveal the motor driven reels behind the front display in the second mode of operation;

the at least one computer also programmed to control the motor driven reels while the front display is at least partially transparent to play a game; and the at least one computer also programmed to control the secondary reels to display symbols that are used in conjunction with either the front display or the motor driven reels.

2. The device of claim 1 wherein the motor driven reels are stepper motor driven reels.

3. The device of claim 1 wherein the front display forms a portion of a first display screen, and the one or more peripheral displays form a second portion of the first display screen.

4. The device of claim 1 wherein the front display comprises a first display screen, and the one or more peripheral displays comprises one or more second display screens separate from the first display screen.

5. The device of claim 1 wherein the at least one computer is programmed to control the front display in the first mode of operation to display one or more symbols that are combinable with symbols displayed by the secondary reels.

6. The device of claim 1 wherein symbols displayed by the secondary reels are scatter symbols that are combined with symbols displayed by the front display or the motor driven reels.

7. The device of claim 1 wherein the first mode of operation of the front display is during a primary game, and the second mode of operation of the front display is during a secondary game that is triggered by an outcome of the primary game.

8. The device of claim 1 wherein the front display displays an M×N array of symbols, where M and N are each greater than one.

9. The device of claim 8 where the M×N array of symbols is combinable with symbols on the secondary reels.

10. The device of claim 1 wherein the front display displays a single symbol at the end of a game, where the single symbol is combinable with symbols on the secondary reels.

11. The device of claim 1 wherein the front display is a touch screen used to select symbols for a Keno game, the secondary reels identify random numbers selected during the Keno game, and the motor driven reels are used during a bonus game upon a trigger condition being achieved during the Keno game.

12. The device of claim 1 wherein the front display displays symbols that are different from symbols displayed by the motor driven reels.

13. The device of claim 1 wherein the one or more peripheral displays completely surround the front display.

14. A method of controlling a gaming device comprising:

providing physical, motor driven reels;

controlling a front display in front of the motor driven reels to be opaque and display symbols or other information in a first mode of operation during a first game;

controlling the front display to be transparent to reveal the motor driven reels behind the front display in a second mode of operation;

controlling the motor driven reels while the front display is at least partially transparent to play a second game; and controlling one or more peripheral displays, that surround the front display on at least three sides of the front display, to display a set of secondary reels, displaying secondary symbols, that are used with either the front display, in the first mode of operation, or the motor driven reels, in the second mode of operation.

15. The method of claim 14 wherein the front display forms a portion of a first display screen, and the one or more peripheral displays form a second portion of the first display screen.

16. The method of claim 14 wherein controlling the front display and controlling the secondary reels comprises controlling the front display in the first mode of operation to display one or more symbols that are combinable with symbols displayed by the secondary reels.

17. The method of claim 14 wherein the secondary symbols displayed by the secondary reels are scatter symbols that are combined with symbols displayed by the front display or the motor driven reels.

18. The method of claim 14 wherein the first mode of operation of the front display is during a primary game, and the second mode of operation of the front display is during a secondary game that is triggered by an outcome of the primary game.

19. The method of claim 14 wherein the front display displays an M×N array of symbols, where M and N are each greater than one.

20. The method of claim 19 where the M×N array of symbols is combinable with symbols on the secondary reels.

* * * * *